US005449657A

United States Patent [19]

Takahashi

[11] Patent Number: 5,449,657

[45] Date of Patent: * Sep. 12, 1995

[54] THERMOSENSITIVE RECORDING MATERIAL

[75] Inventor: Yoshiyuki Takahashi, Kawasaki, Japan

[73] Assignee: New Oji Paper Co., Ltd., Tokyo, Japan

[ * ] Notice: The portion of the term of this patent subsequent to Sep. 21, 2010 has been disclaimed.

[21] Appl. No.: 206,154

[22] Filed: Mar. 7, 1994

[30] Foreign Application Priority Data

Mar. 16, 1993 [JP] Japan ..... 5-055886

[51] Int. Cl.[6] ..... B41M 5/30

[52] U.S. Cl. ..... 503/216; 427/150; 427/151; 503/225

[58] Field of Search ..... 427/150, 151, 152; 503/216, 225

[56] References Cited

U.S. PATENT DOCUMENTS 3,539,375 11/1970 Baum .
5,246,906 9/1993 Takahashi et al. ..... 503/209

FOREIGN PATENT DOCUMENTS 0467621 1/1992 European Pat. Off. ..... 564/47
0526072 2/1993 European Pat. Off. ..... 503/216
43-4160 2/1968 Japan .
45-14039 5/1970 Japan .
48-27736 4/1973 Japan .
56-146794 11/1981 Japan .
59-93387 5/1984 Japan .
59-114096 6/1984 Japan .
59-167292 9/1984 Japan .
60-78782 5/1985 Japan .
62-19485 1/1987 Japan .

*Primary Examiner*—B. Hamilton Hess

*Attorney, Agent, or Firm*—Armstrong, Westerman, Hattori, McLeland & Naughton

[57] ABSTRACT

A thermosensitive recording material having an enhanced color-developing property and a high persistency of the resultant colored images formed thereon, is provided with a thermosensitive colored image-forming layer formed on a substrate sheet and comprising a substantially colorless dye precursor and a color developing agent comprising at least one aromatic compound of the formulae (I) and (II):

$$R^1-SO_2NH\underset{\underset{X}{\|}}{C}NH-R^2 \quad (I)$$

and $$R^3-SO_2NH\underset{\underset{Y}{\|}}{C}NH-R^4 \quad (II)$$

wherein X and Y are an oxygen or sulfur atom, $R^1$ is an alkyl, cycloalkyl, alkenyl or alkynyl group or a hetero atom-containing alkyl, cycloalkyl or alkenyl group having at least one hetero atom included in a backbone group thereof, $R^2$ is an aryl or aralkyl group or a substituted aralkyl group having at least one hetero atom substituent, $R^3$ is an unsubstituted aralkyl group or substituted aralkyl group having at least one hetero atom substituted in an aliphatic hydrocarbon group thereof, and $R^4$ is an unsubstituted or substituted alkyl group, unsubstituted aralkyl group, aryl group, substituted alkyl group, or substituted aralkyl group having at least one hetero atom substituted in an aliphatic hydrocarbon group thereof, an aromatic hydrocarbon ring group included in each of the groups represented by $R^1$ to $R^4$ optionally having at least one substituent.

7 Claims, No Drawings

THERMOSENSITIVE RECORDING MATERIAL

BACKGROUND OF THE INVENTION

1. Field of the Invention

The present invention relates to a thermosensitive recording material on which colored images are formed by heating. More particularly, the present invention relates to a thermosensitive recording material capable of forming thereon colored images resistant to fading and thus exhibiting a high degree of persistency during extended storage thereof.

The thermosensitive recording material of the present invention has a high whiteness and is capable of recording thereon colored images exhibiting an excellent resistance to moisture, heat, oily and fatty substances, and plasticizers, and thus has superior persistency when stored over a long period of time, and therefore is useful as colored image-recording sheets, sheets for use in facsimiles, word processors, CRT image printers and cash dispensers, as passenger tickets, commuter passes, labels such as POS labels, cards such as prepaid cards, and as transit passes.

2. Description of the Related Arts

It is known that a conventional thermosensitive recording material comprises a supporting substrate, for example, a paper sheet, synthetic paper sheet, or plastic resin film and a thermosensitive colored image-forming layer formed on a surface of the supporting substrate and comprising an electron-donative dye precursor, for example, a leuco basic dye, an electron-acceptive color-developing agent consisting of an organic acid substance, for example, a phenolic compound, and a binder. When the thermosensitive colored image-forming layer is heated imagewise, colored images are recorded thereon by a reaction of the dye precursor with the color-developing agent.

This type of thermosensitive recording material is disclosed in Japanese Examined Patent Publication Nos. 43-4,160 and 45-14,039 and Japanese Unexamined Patent Publication No. 48-27,736, and is widely employed in practice.

Namely, the thermosensitive recording material is advantageous in that colored images can be easily formed by heating alone, and the recording apparatus can be made compact and small in size, has a relatively low 10 price, and can be easily maintained. Therefore, this type of thermosensitive recording material is appreciated as a useful information-recording material for recording outputs of printers used with, for example, computers, facsimile machines, automatic ticket-vending machines, scientific measurement recorders, and CRT medical measurement recorders.

Nevertheless, the conventional dye-forming type thermosensitive recording materials in which the thermosensitive colored image-forming layer comprises a conventional color-developing agent together with the dye precursor and the binder is disadvantageous in that the resultant colored images fade with the lapse of time, presumably because of a reversible reaction of the dye precursor with the color-developing agent. This fading of the colored images is accelerated by exposure to light, high temperatures, and high humidity and is specifically promoted by contact with an oily or fatty substance or a plasticizer, to such an extent that the faded images cannot be recognized.

Many attempts have been made to retard or inhibit the fading of the colored images formed on a conventional thermosensitive colored image-forming layer containing a substantially colorless dye precursor comprising a lactone ring compound. For example, Japanese Unexamined Patent Publication Nos. 60-78,782, 59-167,292, 59-114,096 and 59-93,387 disclose a thermosensitive colored image-forming layer containing a phenolic antioxidant.

Japanese Unexamined Patent Publication No. 56-146,794 discloses a protective layer formed from a hydrophobic polymeric compound emulsion on a thermosensitive colored image-forming layer.

Japanese Unexamined Patent Publication No. 62-19,485 discloses that a compound having a certain chemical structure similar to that of the present invention is usable as a material for mainly pressure-sensitive recording paper sheets.

In the thermosensitive colored image-forming layer containing the phenolic antioxidant, the improvement effect of the phenolic antioxidant in the resistance to heat and moisture is not satisfactory. Also, the phenolic antioxidant, sometimes, undesirably causes the resultant colored image-forming layer to exhibit a low degree of whiteness.

When the protective layer or the intermediate and top layers are formed on the thermosensitive colored image-forming layer, the resultant colored images exhibit a significantly enhanced resistance to environmental conditions for a short period of time. Nevertheless, when the colored images are exposed to the environmental conditions for a long period of time, the fading of the colored images cannot be avoided. Also, in this type of recording material since a heat-insulating layer is formed on a surface of the colored image-forming layer, the resultant colored image-forming layer unavoidably exhibits a lowered degree of thermosensitivity during recording.

The compound disclosed in Japanese Unexamined Patent Publication No. 62-19,485 and having a certain chemical structure similar to that of the present invention, exhibits a color-developing activity equal to or lower than that of the conventional phenolic color-developing compounds. This fact will be illustrated in Comparative Examples 2 and 3 hereinafter.

SUMMARY OF THE INVENTION

An object of the present invention is to provide a thermosensitive recording material capable of forming colored images thereon having superior persistency.

Another object of the present invention is to provide a thermosensitive recording material useful as facsimile recording sheets for ordinary use and for permanent storage use, word processor recording sheets, and CRT image printing sheets, which all must have high persistency of colored images recorded thereon.

The above-mentioned objects can be attained by the thermosensitive recording material of the present invention, which comprises a sheet substrate and a thermosensitive colored image-forming layer formed on a surface of the sheet substrate and comprising a substantially colorless dye precursor, a color-developing agent reactive with the dye precursor upon heating to thereby develop a color, and a binder, the color-developing agent comprising at least one aromatic compound of selected from those of the formulae (I) and (II):

$$R^1-SO_2NHC(=X)NH-R^2 \quad (I)$$

wherein X represents a member selected from the group consisting of oxygen and sulfur atoms; $R^1$ represents a member selected from the group consisting of alkyl groups, cycloalkyl groups, alkenyl groups, alkynyl groups, alkyl groups having at least one hetero atom included in a backbone chain thereof, cycloalkyl groups having at least one hetero atom included in a backbone chain thereof, and alkenyl groups having at least one hetero atom included in a backbone chain thereof; and $R^2$ represents a member selected from the group consisting of aryl groups, aralkyl groups and substituted aralkyl groups having at least one hetero atom substituted for at least one carbon atom in an aliphatic hydrocarbon group included therein, an aromatic hydrocarbon ring included in the groups represented by $R^2$ being unsubstituted or substituted with at least one substituent, and $$R^3-SO_2NHC(=Y)NH-R^4 \quad (II)$$

wherein Y represents a member selected from the group consisting of oxygen and sulfur atoms, $R^3$ represents a member selected from the group consisting of unsubstituted aralkyl groups, substituted aralkyl groups having at least one hetero atom substituted for at least one carbon atom in an aliphatic hydrocarbon group included therein, $R^4$ represents a member selected from the group consisting of unsubstituted alkyl groups, aryl groups, unsubstituted aralkyl groups, substituted alkyl groups, and substituted aralkyl groups having at least one hetero atom substituted for at least one carbon atom in an aliphatic hydrocarbon group included therein, an aromatic hydrocarbon ring included in each of the groups represented by $R^3$ and $R^4$ being unsubstituted or substituted by at least one substituent.

DESCRIPTION OF THE PREFERRED EMBODIMENTS

The thermosensitive recording material of the present invention comprises a substrate sheet and a thermosensitive colored image-forming layer formed on a surface of the substrate sheet and comprising a substantially colorless dye precursor, a color-developing agent reactive with the dye precursor upon heating to thereby develop a color, and a binder.

In the present invention, the color-developing agent comprises at least one specific aromatic sulfonyl(thio)urea compound selected from those of the formulae (I) and (II). Those groups of aromatic sulfonyl(thio)urea compounds exhibit a high color-developing activity and effectively develop the dye precursor to form colored images having a significantly high persistency compared with that formed by a conventional color developing agent.

In the aromatic compound of the formula (I):

$$R^1-SO_2NHC(=X)NH-R^2, \quad (I)$$

X represents an oxygen atom or sulfur atom, $R^1$ represents an alkyl group preferably having 1 to 8 carbon atoms, a cycloalkyl group preferably having 3 to 10 carbon atoms, an alkenyl group preferably having 2 to 8 carbon atoms, an alkynyl group preferably having 2 to 8 carbon atoms, a hetero atom-containing alkyl group having at least one hetero atom included in a backbone chain thereof and preferably having 3 to 8 carbon atoms, a hetero atom-containing cycloalkyl group having at least one hetero atom included in a backbone (cyclic) chain thereof and preferably having 2 to 10 carbon atoms, or a hetero atom-containing alkenyl group having at least one hetero atom included in a backbone chain thereof and preferably having 4 to 8 carbon atoms; $R^2$ represents an aryl group, for example, a phenyl, naphthyl, tolyl, xylyl or mesityl group, an aralkyl group for example, a benzyl, methylbenzyl, or naphthylmethyl group, and a substituted aralkyl group having at least one hetero atom substituted for at least one carbon atom in an aliphatic hydrocarbon group included therein and preferably having 7 to 15 carbon atoms, and an aromatic hydrocarbon ring group included in each of the groups represented by $R^1$ and $R^2$may be unsubstituted or substituted with at least one substitutent, for example, a methyl or methoxy group or a chlorine atom.

In the aromatic compound of the formula (II):

$$R^3-SO_2NHC(=Y)NH-R^4, \quad (II)$$

Y represents an oxygen or sulfur atom; $R^3$ represents an unsubstituted aralkyl group, a substituted aralkyl group having at least one hetero atom substituted for at least one carbon atom in an aliphatic hydrocarbon group included therein; $R^4$ represents an unsubstituted alkyl group preferably having 1 to 8 carbon atoms, an aryl group, an unsubstituted aralkyl group, a substituted alkyl group having at least one substituent preferably selected from a fluorine atom and a nitro group, or a substituted aralkyl group having at least one hetero atom substituted for at least one carbon atom in an aliphatic hydrocarbon group included therein, an aromatic hydrocarbon ring group included in each of the group represented by $R^1$ and $R^4$ may be unsubstituted or substituted with at least one substituent, for example, a methyl or methoxy group or a chlorine atom.

In the formula (I), the group represented by $R^1$ is preferably selected from the group consisting of those of the formulae:

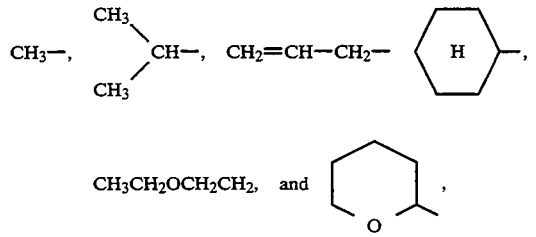

and the group represented by $R^2$ is preferably selected from the group consisting of those of the formulae:

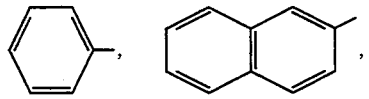

-continued

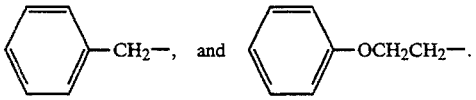

In the formula (II), the group represented by $R^1$ is preferably selected from the group consisting of those of the formulae:

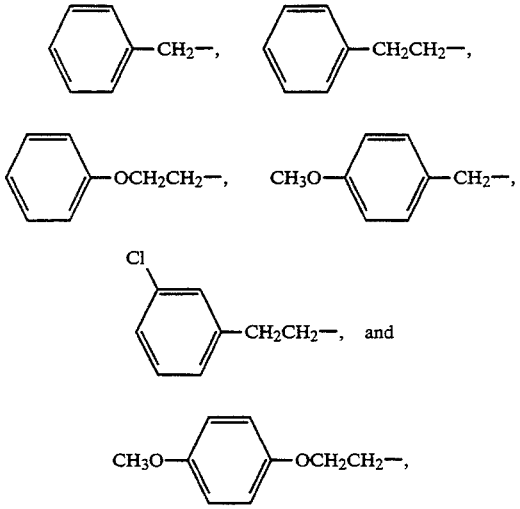

and the group represented by $R_4$ is preferably selected from the group consisting of those of the formulae:

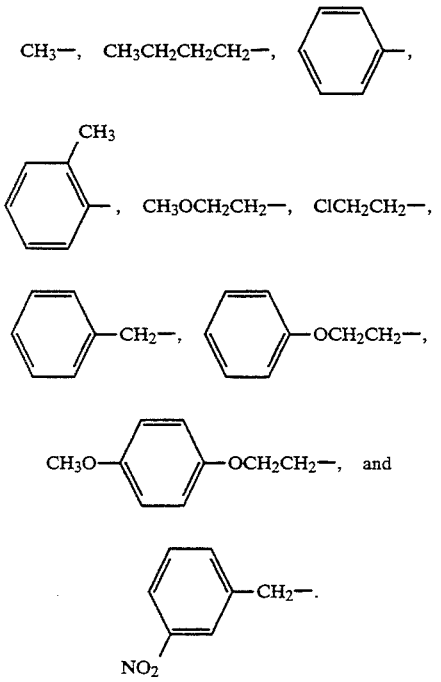

The aromatic compounds of the formulae (I) and (II) serve as a color-developing agent for the substantially colorless dye precursor upon heating to develop a color. The aromatic compounds of the formulae (I) and (II) do not have a common acidic functional group such as phenolic hydroxyl group and carboxyl group. However, these aromatic compounds exhibit a strong color-developing activity for the dye precursor such as leuco basic dye. This strong color-developing activity of the aromatic compounds of the formulae (I) and (II) is assumed to be a result of a strong activation of the (thio)urea group by the sulfonyl group located adjacent to the (thio)urea group. In fact, the sulfonyl(thio)urea group which is a most important functional group of the aromatic compounds of the formulae (I) and (II) is a unique functional group which strongly causes the dye precursor, namely leuco basic dye, to be color developed.

It is confirmed that even if a compound appears to have a chemical structure close to that of the formula (I) or (II), if no functional sulfonyl(thio)urea group is contained, the compound exhibits a significantly poor color-developing activity.

The aromatic compound of the formula (I) is preferably selected from the group consisting of N-methanesulfonyl-N'-phenylurea,
N-methanesulfonyl-N'-1-naphthylurea,
N-trifluoromethanesulfonyl-N'-naphthylurea,
N-ethanesulfonyl-N'-1-naphthylurea,
N-cyclohexanesulfonyl-N'-phenylurea,
N-allylsulfonyl-N'-1-naphthylurea,
N-(2-methoxyethanesulfonyl)-N'-biphenyl-urea,
N-(2-tetrahydropyransulfonyl)-N'-1-naphthylurea,
N-(2-allyloxyethanesulfonyl)-N'-1-naphthylurea,
N-isopropanesulfonyl-N'-benzylurea,
N-isopropanesulfonyl-N'-(4-methylbenzyl)urea,
N-methanesulfonyl-N'-(2-phenoxyethyl)urea,
N-methanesulfonyl-N'-(4-chloro-1-naphthyl)urea,
N-methanesulfonyl-N'-(4-methoxy-1naphthyl)urea,
N-isopropanesulfonyl-N'-(4-chloro-1-naphthyl)urea, and
N-methanesulfonyl-N'-1-naphthyl-thiourea.

The aromatic compound of the formula (II) is preferably selected from the group consisting of N-benzylsulfonyl-N'-phenylurea,
N-(2-phenoxyethane)sulfonyl-N'-phenylurea,
N-(4-methoxybenzyl)sulfonyl-N'-phenylurea,
N-(2-(p-chlorophenyl)ethane)sulfonyl-N'-phenylurea,
N-(p-biphenyl)sulfonyl-N'-butylurea,
N-benzylsulfonyl-N'-benzylurea,
N-benzylsulfonyl-N'-(2-phenoxyethyl)urea,
N-benzylsulfonyl-N'-(p-methoxyphenyl),
N-(p-methoxybenzyl)sulfonyl-N'-(2-(p-chlorophenyloxy)ethyl)urea, and
N-benzylsulfonyl-N'-phenyl-thiourea.

Almost all of the aromatic compounds of the formulae (I) and (II) are novel compounds which were never known in the art. The aromatic compounds of the formulae (I) and (II) can be prepared in accordance with the reactions (1) to (3) shown below.

| Reaction No. | Reaction |
|---|---|
| (1) | $A-SO_2-N=C=O + B-NH_2 \longrightarrow A-SO_2NHC(=O)NH-B$ |
| (2) | $A-SO_2NH_2 + B-N=C=X \longrightarrow A-SO_2NHC(=X)NH-B$ |

-continued

| Reaction No. | Reaction |
|---|---|
| (3) | $A-SO_2NHC(=X)E + B-NH_2 \longrightarrow A-SO_2NHC(=X)NH-B$ |

In the reactions (1) to (3), A and B respectively and independently from each other represent a monovalent organic group as defined for $R^1$, $R^2$, $R^3$ and $R^4$ of the formulae (I) and (II), X represents an oxygen or sulfur atom and E represents a lower alkyl group or aryl group.

In the thermosensitive colored image-forming layer of the present invention, the content of the color-developing aromatic compound of the formula (I) and/or (II) is preferably in the range of from 10 to 50% based on the total dry weight of the thermosensitive colored image-forming layer. When the content is less than 10% by weight, the resultant thermosensitive colored image-forming layer exhibits an unsatisfactory color-developing activity. Also, even if the content of the color-developing aromatic compound is raised to a level above 50% by weight, the color-developing activity of the resultant thermosensitive colored image-forming layer is saturated and no further improvement in the color-developing activity is obtained and it causes an economical disadvantage.

In the thermosensitive colored image-forming layer of the present invention, the color-developing agent comprises one or two or more of the above-mentioned specific aromatic compounds.

The dye precursor usable for the present invention comprises at least one member selected from conventional triphenylmethane, fluoran, and diphenylmethane leuco dyes, for example, 3-(4-diethylamino-2-ethoxyphenyl)-3-(1-ethyl-2-methylindole-3-yl)-4-azaphthalide, crystal violet lactone, 3-(N-ethyl-N-isopentylamino)-6-methyl-7-anilinofluoran, 3-diethylamino-6-methyl-7-anilinofluoran, 3-diethylamino-6-methyl-7-(o, p-dimethylphenylamino)fluoran, 3-(N-ethyl-N-p-toluidino)-6-methyl-7-anilinofluoran, 3-pyrrolidino-6-methyl-7-anilinofluoran, 3-dibutylamino-6-methyl-7-anilinofluoran, 3-(N-cyclohexyl-N-methylamino)-6-methyl-7-anilinofluoran, 3-diethylamino-7-(o-chloroanilino)fluoran, 3-diethylamino-7-(m-trifluoromethylanilino)fluoran, 3-diethylamino-6-methyl-7-chlorofluoran, 3-diethylamino-6-methylfluoran, 3-cyclohexylamino-6-chlorofluoran, 3-(N-ethyl-N-hexylamino)-6-methyl-7-(p-chloroanilino)fluoran, 2-chloro-3-methyl-6-(N,N-dibutylamino-anilino) fluoran, 3-(p-anilinoanilino)-6-methyl-7-anilinofluoran, 3,6-bis (dimethylamino)fluoran-9-spiro-3'-(6'-dimethylaminophthalide), 3,3-bis(2-(p-dimethylaminophenyl)-2-(p-methoxyphenyl)ethenyl)-4,5,6,7-tetrachlorophthalide, and bis(p-dimethylaminostyryl)-p-toluenesulfonylmethane.

In the thermosensitive colored image-forming layer of the present invention, the color-developing agent optionally contains at least one other or conventional color-developing compound in addition to the aromatic compounds of the formulae (I) and (II), unless the color-forming performance of the resultant colored image-forming layer is disturbed thereby.

The other color-developing compound is preferably selected from the N-aryl sulfonylurea compounds of the formulae (III) and (IV):

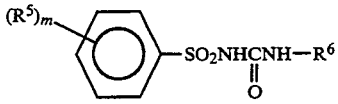

(III)

wherein $R^5$ represents a member selected from the group consisting of hydrogen and halogen atoms, and lower alkyl groups preferably having 1 to 4 carbon atoms, aryl groups, for example, phenyl and tolyl groups, alkoxyl groups preferably having 1 to 4 carbon atoms, an acetyl group and a nitro group, and $R^6$ represents a member selected from the group consisting of aralkyl, unsubstituted phenyl and naphthyl groups and substituted phenyl and naphthyl groups having at least one substituent selected from the group consisting of alkoxyl, acetyl, nitro and lower alkyl groups and halogen atoms, the substituents represented by $R^5$ may be the same as or different from each other, and

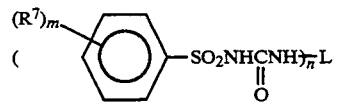

(IV)

wherein $R^7$ represents a member selected from the group consisting of hydrogen and halogen atoms and lower alkyl, aryl, alkoxyl, acetyl and nitro groups, m represents an integer of 1 to 5, n represents an integer of 2 or more, and L represents a di- or more valent group; and conventional color developing phenolic compounds and organic acids.

The other color developing compounds are preferably selected from the group consisting of:

N-(p-toluenesulfonyl)-N'-phenylurea,
N-(p-toluenesulfonyl)-N'-(p-methoxyphenyl)urea,
N-(p-toluenesulfonyl)-N'-(o-tolyl)urea,
N-(p-toluenesulfonyl)-N'-(m-tolyl)urea,
N-(p-toluenesulfonyl)-N'-(p-tolyl)urea,
N-(p-toluenesulfonyl)-N'-(o-chlorophenyl)urea,
N-(p-toluenesulfonyl)-N'-benzylurea,
N-(p-toluenesulfonyl)-N'-(1-naphthyl)urea,
N-(benzenesulfonyl)-N'-phenylurea,
N-(p-chlorobenzenesulfonyl)-N'-phenylurea,
N-(o-toluenesulfonyl)-N'-phenylurea,
N-(p-toluenesulfonyl)-N'-(o-diphenyl)urea,
N-(p-toluenesulfonyl)-N'-(p-ethoxycarbonylphenyl-)urea,
N-(p-methoxybenzenesulfonyl)-N'-phenylurea,
N-(p-acetylbenzenesulfonyl)-N'-phenylurea,
N-(3-nitrobenzenesulfonyl)-N'-phenylurea,
N-(3-nitro-4-methoxybenzenesulfonyl)-N'-phenylurea,
N-(benzenesulfonyl)-N'-(p-methoxyphenyl)urea,
N-(toluenesulfonyl)-N'-(4-nitro-1-naphthyl)urea,
N-(benzenesulfonyl)-N'-p-acetylphenylurea,
N-(p-acetylbenzenesulfonyl)-N'-(m-tolyl)urea,
N-(p-methoxybenzenesulfonyl)-N'-benzylurea,
1,3-bis(p-toluenesulfonylaminocarbonylaminomethyl)benzene,
1,4-bis(p-toluenesulfonylaminocarbonylaminomethyl)benzene,
4,4'-bis(p-toluenesulfonylaminocarbonylamino)diphenylmethane, 4,4'-bis(o-toluenesulfonylaminocarbonylamino)diphenylmethane,
4,4'-bis(benzenesulfonylaminocarbonylamino)diphenylmethane,
4,4'-bis(1-naphthalenesulfonylaminocarbonylamino)-diphenylmethane,
4,4'-bis(p-toluenesulfonylaminothiocarbonylamino)-diphenylmethane,
2,2'-bis(4',4''-(p-toluenesulfonylaminocarbonylamino)phenyl)propane,
1,2-bis (4'-(p-toluenesulfonylaminocarbonylamino)-phenyloxy)ethane,
3,3'-bis(p-toluenesulfonylaminocarbonylamino)-diphenylsulfone,
3,3'-bis(p-chlorobenzenesulfonylaminocarbonylamino)diphenylsulfone,
4,4'-bis(p-toluenesulfonylaminocarbonylamino)diphenylether,
2,5-bis(p-toluenesulfonylaminocarbonylaminomethyl)furan,
1,3-bis(p-toluenesulfonylaminocarbonylamino)benzene,
1,4-bis(p-toluenesulfonylaminocarbonylamino)benzene,
1,5-bis(p-toluenesulfonylaminocarbonylamino)naphthalene,
1,8-bis(p-toluenesulfonylaminocarbonylamino)naphthalene,
1,4-bis(3'-(p-toluenesulfonylaminocarbonylamino)-phenyloxy)benzene,
2,2-bis(4-hydroxyphenyl)propane (namely bisphenol A),
1,1 -bis(4-hydroxyphenyl)-1-phenylethane,
1,4 -bis(1-methyl-1-(4'-hydroxyphenyl)ethyl)benzene,
1,3 -bis(1-methyl-1-(4'-hydroxyphenyl)ethyl)benzene,
dihydroxydiphenylether (disclosed in JP-A-1-180,382),
benzyl p-hydroxybenzoate (disclosed in JP-A-52-140,483),
bisphenol S,
4-hydroxy-4'-isopropyloxy-diphenylsulfone (disclosed in JP-A-60-13,852),
1,1-di(4-hydroxyphenyl)-cyclohexane,
1,7-di(4-hydroxyphenylthio)-3,5-dioxaheptane (disclosed in JP-A-59-52,694), and
3,3'-diallyl-4,4'-dihydroxydiphenylsulfone (disclosed in JP-A-60-208,286).

The above-mentioned other or conventional color-developing compounds can be employed alone or as a mixture of two or more thereof.

When another or a conventional color-developing compound is employed, its content in the colored image-forming layer is preferably 5 to 40% by weight.

The binder serves to bond the components in the colored image-forming layer to the substrate sheet and preferably comprises at least one member selected from water-soluble polymeric materials, for example, polyvinyl alcohols of various molecular weight, starch and starch derivatives, cellulose derivatives, for example, methoxy cellulose, carboxymethyl cellulose, methyl cellulose and ethyl cellulose, sodium polyacrylate, polyvinyl pyrrolidine, acrylic acid amide-acrylic acid ester copolymers, acrylic acid amide-acrylic acid estermethacrylic acid terpolymers, alkali salts of styrenemaleic anhydride copolymers, polyacrylic acid amide, sodium alginate, gelatine and casein, and water-insoluble polymeric materials, for example, polyvinyl acetate resins, polyurethane resins, styrene-butadiene copolymer resins, polyacrylic acid resins, polyacrylic acid ester resins, vinyl chloride-vinyl acetate copolymer resins, polybutyl acrylate, ethylene-vinyl acetate copolymer resins and styrene-butadiene-acrylic compound-terpolymer resins, used in the form of a latex.

In the thermosensitive colored image-forming layer of the present invention, the dye precursor is present in an amount of 5 to 20% of weight together with 10 to 50% of the color-developing aromatic compound of the formula (I) and/or (II) and the binder is present in an amount of 5 to 20% by weight, based on the total dry weight of the colored image-forming layer.

The thermosensitive colored image-forming layer of the present invention optionally further comprises a heat-fusible organic substance, usually referred to as a sensitizer, inorganic and organic pigments, antioxidants, for example, hindered phenol compounds, ultraviolet ray-absorbers, and waxes.

The sensitizing agent comprises at least one organic compound having a melting point of from 50° C. to 150° C., for example, phenyl 1-hydroxy-2-naphthoate (disclosed in JP-A-57-191,089), p-benzylbiphenyl (JP-A-60-82,382), benzylnaphthylether (JP-A-58-87,094), dibenzyl terephthalete (JP-A-58-98,285), benzyl p-benzyloxybenzoate (JP-A-57-201,691), diphenyl carbonate, ditolyl carbonate (JP-A-58-136,489), m-terphenyl (JP-A-57-89,994), 1,2-bis(m-tolyloxy)ethane (JP-A-60-56,588), 1,5-bis(p-methoxyphenoxy)-3-oxapentane (JP-A-62-181,183), oxalic acid diesters (JP-A-64-1,583), 1,4-bis(p-tolyloxy)benzene (JP-A-2-153,783), diphenyl sulfone (melting point: 124° C.), phenyl p-toluenesulfonate (m.p.: 96° C.), p-tolyl mesitylenesulfonate (m.p.: 100 to 102° C.), 4,4'-diallyloxydiphenylsulfone (m.p.: 145° C.), 4,4'-diisopentyloxydiphenylsulfone (m.p.: 100° C.), 4,4'-dimethoxydiphenylsulfone (m.p.: 130° C.), bis(4-(2-(($C_{14}$, $C_{16}$ or $C_{18}$)alkanoyl or alkenoyloxy)ethoxy)-phenyl)sulfone, 2,2-bis(4-benzenesulfonyloxyphenyl)-propane (m.p.: 114° C.), 2,2bis(4-methanesulfonyloxyphenyl)propane (m.p.: 101° C.), p-toluenesulfonanilide (m.p.: 102° C.) and N-benzyl-o-sulfophthalimide.

The thermosensitive colored image-forming layer optionally contains an antioxidant, for example, hindered phenolic compound and/or ultraviolet ray-absorbers.

The antioxidant and ultraviolet ray-absorbers are preferably selected from those disclosed in JP-A-57-151,394, JP-A-58-160,191, JP-A-58-69,096, JP-A-59-2,884, JP-A-59-95,190, JP-A-60-22,288, JP-A-60-255,485, JP-A-61-44,686, JP-A-62-169,683, JP-A-63-17,081, JP-A-1-249,385, and JP-A-4-144,786 for example, 1,1,3-tris(2'-methyl-3'-cyclohexyl-4,hydroxyphenyl)butane; 1,1,3-tris(2-methyl-4-hydroxy-5-tert-butylphenyl)butane, 4,4'-thio-bis(3-methyl-6-tert-butylphenol), 1,3,5-trimethyl-2,4,6-tris(3,5-di-tert-butyl-4-hydroxybenzyl)benzene, 2,2'-dihydroxy-4,4'-dimethoxybenzophenone, p-octylphenyl salicylate, 2-(2'-hydroxy-5'-methylphenyl)benzotriazole, ethyl-2-cyano-3,3'-diphenyl acrylate, and tetra(2,2,6,6-tetramethyl-4-piperidyl)-1,2,3,4-butane-tetracarbonate.

The inorganic and organic pigments usable for the present invention are preferably selected from inorganic fine particles of, for example, calcium carbonate, silica, zinc oxide, titanium dioxide, aluminum hydroxide, zinc hydroxide, barium sulfate, clay, anhydrous clay, talc, surface-modified calcium carbonate and silica and organic fine particles of, for example, urea-formaldehyde resins, styrene-methacrylate copolymer resins and polystyrene resins.

The waxes usable for the present invention preferably comprise at least one member selected from, for example, paraffin waxes, carnauba wax, microcrystalline waxes, polyethylene waxes, amide type waxes, bisimide type waxes, higher fatty acid amide waxes, for example, stearic acid amide, ethylene-bis-stearoamide wax, higher fatty acid esters and metal salts, for example, zinc stearate, aluminum stearate, calcium stearate, and zinc oleate.

In the colored image forming layer of the present invention, the sensitizing agent is preferably contained in an amount of 10 to 40% by weight, the wax and organic or inorganic pigment are optionally contained in amounts of 2 to 20% by weight and 2 to 50% by weight, respectively, and the antioxidant and ultraviolet ray-absorber are optionally contained in an amount of 1 to 10%, based on the total dry weight of the colored image-forming layer.

The sheet substrate usable for the present invention is not limited to a specific group of materials, and usually the sheet substrate comprises a member selected from fine paper sheets, coated paper sheets having a clay or latex-coated layer, cast-coated paper sheets, paper boards, plastic resin films, synthetic paper sheets comprising a plastic resin such as a polyolefin resin and a multi-layer structure, and laminated composite sheets. Preferably, the sheet substrate has a basis weight of 40 to 170 g/m$^2$.

The colored image-forming layer can be formed on a surface of sheet substrate, by applying a coating liquid containing the above-mentioned components, and by drying and solidifying the coating liquid layer on the sheet substrate.

The colored image-forming layer is preferably present in a dry weight of from 1 to 15 g/m$^2$, more preferably 2 to 10 g/m$^2$.

In the present thermosensitive recording material, a protective layer and/or a layer for printing may be formed on the colored image-forming layer.

The thermosensitive recording material of the present invention is provided with a specific thermosensitive colored image-forming layer characterized by containing a specific color-developing agent. This specific color-developing agent comprises at least one aromatic compound selected from those of the formulae (I) and (II), and causes not only the resultant thermosensitive colored image-forming layer to exhibit a high whiteness and a satisfactory thermosensitivity, but also the resultant colored images on the colored image-forming layer exhibit an excellent resistance to oily and fatty substances and a plasticizer even immediately after the color development, and thus have a superior storage persistency.

EXAMPLES

The present invention will be further explained by the following specific examples, which are merely representative and do not in any way restrict the scope of the present invention.

SYNTHESIS EXAMPLE 1

(Preparation of N-methanesulfonyl-N'-1-naphthylurea)

Methanesulfonamide in an amount of 9.5 g was mixed with 17.7 g of 1-naphthyl isocyanate in a nitrogen gas atmosphere, and the resultant mixture was heated at a temperature of 140° C. for 2 hours while stirring. Then, the mixture was cooled to room temperature and subjected to an extraction with a 5% sodium hydroxide aqueous solution. When the extracted solution was made weakly acidic, a light pink-colored solid product was obtained. The solid product was dried, recrystallized from toluene. A white crystalline substance was obtained. The yield of the crystalline product was 71% and the melting temperature of the product was 116° C.

The product was subjected to a mass spectrometric analysis. As a result, a molecular ion peak (m/e=264) of the crystalline product was confirmed. Also the following peaks were confirmed by a NMR analysis in deuterated dimethyl sulfoxide (DMSO) and it was identified that the resultant product was the aimed compound.

$\delta$=3.33 (s. 3H), 7.46–8.04 (m. 7H)

Another peak was confirmed at about 10.5.

SYNTHESIS EXAMPLE 2

(Preparation of N-benzylsulfonyl-N'-phenylurea)

Benzylsulfonamide in an amount of 11.4 g was mixed with 8.4 g of phenylisocyanate in an nitrogen gas atmosphere, and the resultant mixture was stirred for 2 hours while heating at a temperature of 140° C. The reaction mixture was cooled to room temperature and subjected to an extraction with a 5% sodium hydroxide aqueous solution. When the extracted solution was made weakly acidic, a white solid product was formed. The solid product was dried and recrystallized from toluene. The white solid product was obtained in an yield of 84% and had a melting temperature of 186° C.

The product was subjected to a mass spectrometric analysis. As results, the molecular ion peak (m/e=290) of the crystalline product was confirmed. Also, the following peaks were confirmed by an NMR analysis in deuterated DMSO and it was identified that the resultant product was the aimed compound.

$\delta$=4.78 (s. 2H), 7.07–7.47 (m. 10H) Another peak was confirmed at about 10.2.

EXAMPLE 1

A thermosensitive recording paper sheet was prepared by the following procedures.

(1) Preparation of an Aqueous Dye Precursor Dispersion A

A mixture was prepared in the following composition.

| Component | Part by weight |
|---|---|
| 3-(N-isopentyl-N-ethylamino)-6-methyl-7-anilinofluoran | 20 |
| 10% aqueous solution of polyvinyl alcohol | 10 |
| Water | 70 |

The mixture was dispersed by using a paint shaker to an extent such that the resultant dispersed solid particles had an average size of 1 $\mu$m or less.

(2) Preparation of an Aqueous Color-Developing Agent Dispersion B

| Component | Part by weight |
|---|---|
| N-Benzylsulfonyl-N'-phenylurea (Synthesis Example 2) | 10 |
| Di(p-methylbenzyl)oxalate | 10 |
| 10% aqueous solution of polyvinyl alcohol | 10 |

-continued

| Component | Part by weight |
|---|---|
| Water | 70 |

The mixture was dispersed by using a paint shaker to such an extent that the resultant dispersed solid particles had an average size of 1 μm or less.

(3) Preparation of a Pigment-Coated Paper Sheet

A coating liquid was prepared by mixing an aqueous dispersion prepared by dispersing 85 parts by weight of anhydrous clay available under the trademark of Ansilex, from Engelhard Corporation, in 320 parts by weight of water, with 40 parts by weight of an aqueous emulsion of a styrene-butadiene copolymer in a solid concentration of 50% by weight and 50 parts by weight of a 10% aqueous oxidized starch solution.

The coating liquid was coated on a surface of a fine paper sheet having a basis weight of 48 g/m$^2$, to form a coating layer having a dry weight of 7.0 g/m$^2$, whereby a coated paper sheet was obtained.

(4) Formation of Thermosensitive Colored Image-forming Layer

A coating liquid was prepared by evenly mixing parts by weight of the aqueous dye precursor dispersion A and 200 parts by weight of the aqueous color-developing agent dispersion B with 30 parts by weight of a calcium carbonate pigment, 20 parts by weight of a 25% aqueous zinc stearate dispersion, 15 parts by weight of a 30% aqueous paraffin dispersion, and 100 parts by weight of a 10% aqueous polyvinyl alcohol solution, by agitating the mixture.

A surface of the pigment coated paper sheet was coated with the resultant coating liquid and dried. A thermosensitive colored image-forming layer was formed in a weight of 5.0 g/m$^2$, to provide a thermosensitive recording paper sheet.

(5) Super Calender Treatment

The recording sheet was treated by a super calender, and the calendered surface of the recording sheet had a Bekk smoothness of 800 to 1000 seconds.

(6) Color-Developing Test

The specimen of the resultant thermosensitive recording sheet was subjected to a colored image-developing test by using a dynamic color-developing tester provided by modifying a thermosensitive facsimile printer with an applied energy of 0.44 mj/dot. The resultant colored images were subjected to a measurement of a color density by a Macbeth Reflection Color Density Tester RD-914 (trademark).

The measured color density of the colored images on the specimen is referred to as an original color density ($D_0$) of the colored images.

The test result is shown in Table 1.

(7) Moisture Resistance Test

Specimens of the colored image-formed recording paper sheet were subjected to a moisture resistance test in which the specimen was placed in a weathering tester at a temperature of 40° C. at a relative humidity of 90% for 48 hours. Then the specimen was taken up from the tester and the color density of the colored images retained on the specimen was measured by the Macbeth Reflection Color Density Tester as mentioned above. The measured color density is referred to as a color density ($D_13$) after moisture resistance test.

The test result is shown in Table 1.

EXAMPLE 2

A thermosensitive recording sheet was produced by the same procedures as in Example 1 except that in the preparation of the dispersion B, N-benzylsulfonyl-N'-phenylurea was replaced by N-methanesulfonyl-N'-1-naphthylurea (Synthesis Example 1), and di(p-methylbenzyl)oxalate was replaced by diphenylsulfone.

The test results are shown in Table 1.

EXAMPLE 3

A thermosensitive recording sheet was produced by the same procedures as in Example 1 except that in the preparation of the dispersion A, 3-(N-isopentyl-N-ethylamino)-6-methyl-7-anilinofluoran was replaced by 3-(N,N-dibutyl-N-ethylamino)-6-methyl-7-anilinofluoran.

The test results are shown in Table 1.

COMPARATIVE EXAMPLE 1

A thermosensitive recording sheet was produced by the same procedures as in Example 1 except that in the preparation of the dispersion B, N-benzylsulfonyl-N'-phenylurea was replaced by 2,2-bis(4-hydroxyphenyl)-propane, namely Bisphenol A.

The test results are shown in Table 1.

COMPARATIVE EXAMPLE 2

A thermosensitive recording sheet was produced by the same procedures as in Example 1 except that in the preparation of the dispersion B, N-benzylsulfonyl-N'-phenylurea was replaced by N-(p-nitrobenzoyl)-p-toluenesulfonamide (which had a melting temperature of 206° C. and disclosed in JP-A-62-19,485).

The test results are shown in Table 1.

COMPARATIVE EXAMPLE 3

A thermosensitive recording sheet was produced by the same procedures as in Example 1 except that in the preparation of the dispersion B, N-benzylsulfonyl-N'-phenylurea was replaced by N-(o-carboxybenzoyl)-p-toluenesulfonamide (having a melting point of 161° C. and disclosed in JP-A-62-19,485).

The test results are shown in Table 1.

TABLE 1

| | | Item Color density of colored image | |
|---|---|---|---|
| Example No. | | Original ($D_0$) | After moisture resistance test ($D_1$) |
| Example | 1 | 1.37 | 1.14 |
| | 2 | 1.42 | 1.18 |
| | 3 | 1.44 | 1.20 |
| Comparative Example | 1 | 1.43 | 0.82 |
| | 2 | 0.79 | 0.64 |
| | 3 | 0.40 | 0.33 |

Table 1 clearly indicates that the specific color-developing agent of the present invention exhibited a satisfactory color developing activity substantially equal to that of a typical conventional color-developing agent, namely bisphenol A, and the resultant colored images formed on the thermosensitive recording material of the present invention had an enhanced persistency in storage. Also, as is clear from Comparative Examples 2 and 3, in which the color-developing compounds as used had a certain common chemical structure with those of the present invention but do not have the sulfonyl(thio)urea group, the specific aromatic compounds of the formulae (I) and (II) exhibited an unexpectedly very high color-developing activity in comparison with that of the comparative examples.

The thermosensitive recording material of the present invention contains a specific aromatic sulfonyl(thio)urea compound of the formula (I) and/or (II), as a color-developing agent, in the thermosensitive colored image-forming layer thereof. This colored image-forming layer exhibits an excellent color-developing performance and the resultant colored image exhibits an enhanced persistency in storage, compared with those of conventional colored image-forming layer.

Therefore, the thermosensitive recording material of the present invention has a high utilizability for practical use.

That which is claimed:

1. A thermosensitive recording material comprising:

a substrate sheet; and a thermosensitive colored image-forming layer formed on a surface of the substrate sheet and comprising a substantially colorless dye precursor, a color developing agent reactive with the dye precursor upon heating to thereby develop a color, and a binder, the color developing agent comprising at least one aromatic compound selected from those of the formulae (I) and (II):

$$R^1-SO_2NHC(=X)NH-R^2 \quad \text{(I)}$$

wherein X represents a member selected from the group consisting of oxygen and sulfur atoms; $R^1$ represents a member selected from the group consisting of alkyl groups, cycloalkyl groups, alkenyl groups, alkynyl groups, alkyl groups having at least one hetero atom included in a backbone chain thereof, cycloalkyl groups having at least one hetero atom included in a backbone chain thereof, and alkenyl groups having at least one hetero atom included in a backbone chain thereof; and $R^2$ represents a member selected from the group consisting of aryl groups, aralkyl groups and substituted aralkyl groups having at least one hetero atom substituted for at least one carbon atom in an aliphatic hydrocarbon group included therein, an aromatic hydrocarbon ring included in the group represented by $R^2$ being unsubstituted or substituted with at least one substituent, and $$R^3-SO_2NHC(=Y)NH-R^4 \quad \text{(II)}$$

wherein Y represents a member selected from the group consisting of oxygen and sulfur atoms, $R^3$ represents a member selected from the group consisting of unsubstituted aralkyl groups, substituted aralkyl groups having at least one hetero atom substituted for at least one carbon atom in an aliphatic hydrocarbon group included therein, $R^4$ represents a member selected from the group consisting of unsubstituted alkyl groups, aryl groups, unsubstituted aralkyl groups, substituted alkyl groups, and substituted aralkyl groups having at least one hetero atom substituted for at least one carbon atom in an aliphatic hydrocarbon group included therein, an aromatic hydrocarbon ring included in each of the groups represented by $R^3$ and $R^4$ being unsubstituted or substituted with at least one substituent.

2. The thermosensitive recording material as claimed in claim 1, wherein in the formula (I), the group represented by $R^1$ is selected from the group consisting of those of the formulae:

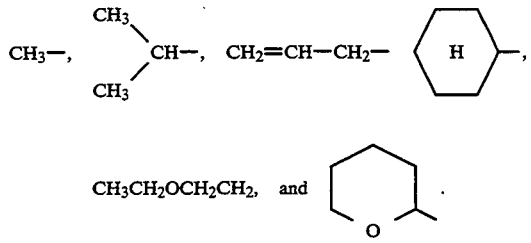

3. The thermosensitive recording material as claimed in claim 1, wherein in the formula (I), the group represented by $R^2$ is selected from the group consisting of those of the formulae:

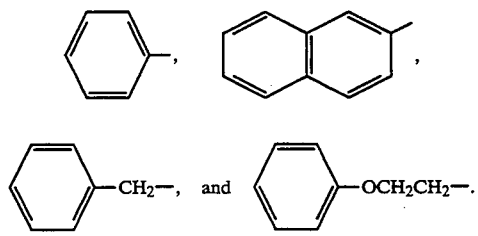

4. The thermosensitive recording material as claimed in claim 1, wherein in the formula (II), the group represented by $R^3$ is selected from the group consisting of those of the formulae:

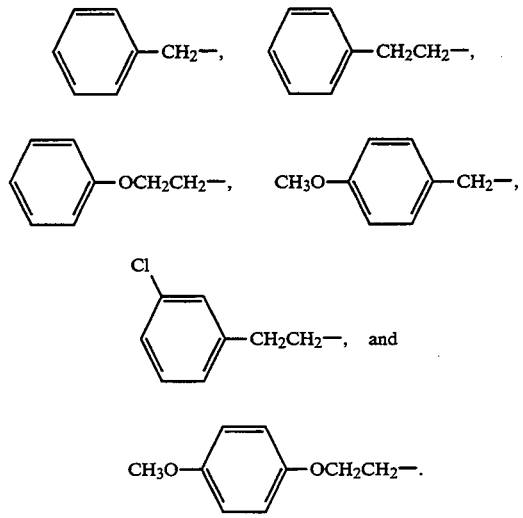

5. The thermosensitive recording material as claimed in claim 1, wherein in the formula (II), the group represented by $R^4$ is selected from the group consisting of those of the formulae:

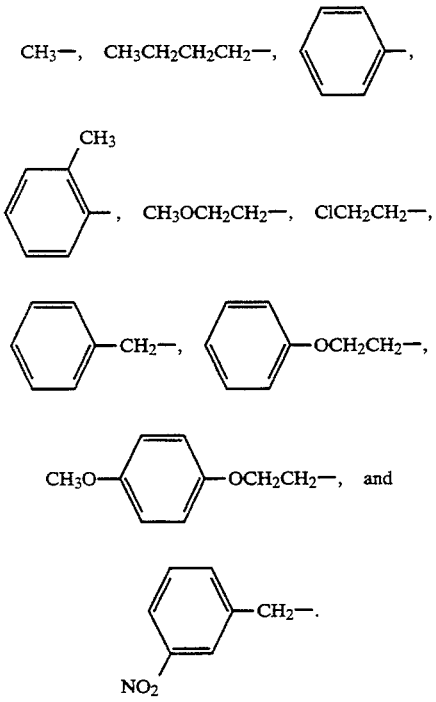

6. The thermosensitive recording material as claimed in claim 1, wherein the aromatic compound of the formula (I) is selected from the group consisting of N-methanesulfonyl-N′-phenylurea,
N-methanesulfonyl-N′-1-naphthylurea,
N-trifluoromethanesulfonyl-N′-naphthylurea,
N-ethanesulfonyl-N′-1-naphthylurea,
N-cyclohexanesulfonyl-N′-phenylurea,
N-allylsulfonyl-N′-1-naphthylurea,
N-(2-methoxyethanesulfonyl)-N′-biphenylurea,
N-(2-tetrahydropyransulfonyl)-N′-1-naphthylurea,
N-(2-allyloxyethanesulfonyl)-N′-1-naphthylurea,
N-isopropanesulfonyl-N′-benzylurea,
N-isopropanesulfonyl-N′-(4-methylbenzyl)urea,
N-methanesulfonyl-N′-(2-phenoxyethyl)urea,
N-methanesulfonyl-N′-(4-chloro-1-naphthyl)urea,
N-methanesulfonyl-N′-(4-methoxy-1naphthyl)urea,
N-isopropanesulfonyl-N′-(4-chloro-1-naphthyl)urea, and
N-methanesulfonyl-N′-1-naphthyl-thiourea.

7. The thermosensitive recording material as claimed in claim 1, wherein the aromatic compound of the formula (II) is selected from the group consisting of N-benzylsulfonyl-N′-phenylurea,
N-(2-phenoxyethane)sulfonyl-N′-phenylurea,
N-(4-methoxybenzyl)sulfonyl-N′-phenylurea,
N-(2-(p-chlorophenyl)ethane)sulfonyl-N,phenylurea,
N-(p-biphenyl)sulfonyl-N′-butylurea,
N-benzylsulfonyl-N′-benzylurea,
N-benzylsulfonyl-N′-(2-phenoxyethyl)urea,
N-benzylsulfonyl-N′-(p-methoxyphenyl)urea,
N-(p-methoxybenzyl)sulfonyl-N′-(2-(p-chlorophenyloxy)ethyl)urea, and
N-benzylsulfonyl-N′-phenyl-thiourea.

* * * * *